US005275419A

United States Patent [19]

Kazemi

[11] Patent Number: 5,275,419

[45] Date of Patent: Jan. 4, 1994

[54] PROJECTILE AND TARGET GAME APPARATUS

[76] Inventor: Enayatolah Kazemi, 1840 Archer La., N., Plymouth, Minn. 55447

[21] Appl. No.: 972,600

[22] Filed: Nov. 6, 1992

[51] Int. Cl.[5] ..... A63B 63/08; A42B 1/04

[52] U.S. Cl. ..... 273/402; D2/882; D21/5; 2/DIG. 11; 2/209.13; 2/195.1; 273/DIG. 17

[58] Field of Search ..... 273/400–402, DIG. 17, 320, D2/244; 2/195, 196, DIG. 11; D21/5, 201

[56] References Cited

U.S. PATENT DOCUMENTS

| | | | |
|---|---|---|---|
| D. 299,362 | 1/1989 | Malfitano | D21/5 |
| 1,753,309 | 4/1930 | Costello | 273/DIG. 17 X |
| 1,944,628 | 1/1934 | Barker | 273/320 |
| 2,082,083 | 6/1937 | Swift | 273/DIG. 17 X |
| 2,196,253 | 4/1940 | DiBella | 273/320 |
| 3,613,294 | 10/1970 | Graham | 273/DIG. 17 X |
| 3,628,794 | 12/1971 | Conture | 273/DIG. 17 X |
| 3,766,565 | 10/1973 | Cozzens | D2/244 X |
| 3,901,505 | 8/1975 | Gerechter | 273/1 M |
| 4,047,717 | 9/1977 | DeAngelis | 273/95 |
| 4,059,271 | 11/1977 | Dupre | 273/95 |
| 4,213,611 | 7/1980 | Hicks | 273/414 |
| 4,292,689 | 10/1981 | Townsend, Jr. | D2/244 X |
| 4,360,206 | 11/1982 | Bian | 273/344 |
| 4,630,317 | 12/1986 | Brown et al. | 2/DIG. 11 |
| 4,718,677 | 1/1988 | Barnes | 273/412 |
| 4,735,420 | 4/1988 | Seidler | 273/412 |
| 4,783,092 | 11/1988 | Kandal | 273/319 |
| 4,836,555 | 6/1989 | Wexler | 273/330 |
| 4,863,174 | 9/1989 | Cummings | 273/322 |
| 4,871,178 | 10/1989 | Diaz | 273/411 |
| 4,936,584 | 6/1990 | Ewald et al. | 273/DIG. 17 X |
| 4,971,334 | 11/1990 | Stewart | 273/346 |
| 5,058,898 | 10/1991 | Chen | 273/401 |
| 5,082,289 | 1/1992 | Paranto et al. | 273/318 |
| 5,082,291 | 1/1992 | Appel et al. | 273/DIG. 17 X |
| 5,085,442 | 2/1992 | Lee | 273/346 |
| 5,102,146 | 4/1992 | Kurland | 273/412 |

FOREIGN PATENT DOCUMENTS

| | | | |
|---|---|---|---|
| 923538 | 12/1947 | France | 273/320 |
| 1238985 | 7/1960 | France | 273/DIG. 17 |
| 6214 | of 1896 | United Kingdom | 273/DIG. 17 |
| 2240029 | 7/1991 | United Kingdom | 2/195 |

*Primary Examiner*—Paul E. Shapiro
*Attorney, Agent, or Firm*—David B. Kagan

[57] ABSTRACT

Game apparatus comprises a projectile and a head garment. The head garment includes a head-fitting member configured and dimensioned to be releasably worn on the head of the player. The head garment also includes a visor attached to said head-fitting member, wherein the visor is configured with an aperture of sufficient size to allow said projectile to pass through the aperture.

7 Claims, 2 Drawing Sheets

PROJECTILE AND TARGET GAME APPARATUS

FIELD OF THE INVENTION

The present invention relates to a game apparatus, and more particularly to a projectile and target game apparatus.

BACKGROUND OF THE INVENTION

Throwing games in which one player attempts to throw a projectile at or through a target carried by another player are known in the art. For example, U.S. Pat. No. 4,871,178 describes a game in which a hoop device is supported between the legs of a player. Such a device, however, severely restricts the mobility of the player wearing the hoop device.

Games in which the target is disposed on hands, elbows, chest, back and head are also known. See, e.g., U.S. Pat. Nos. 5,102,146; 5,085,442; 5,082,291; 4,971,334; 4,735,420; and 4,718,677. In such games, the surface of the target and the projectile include hook and loop fastening type materials (such as VELCRO brand materials) so that the projectile and target releasably bond upon contact. These kinds of devices, however, have not been entirely satisfactory for use in continuous action style games in which players try to avoid being hit by projectiles being thrown by other players. Play must be stopped frequently so that projectiles can be removed from players who have been "hit". Such interruptions can be frustrating for the players.

SUMMARY OF THE INVENTION

The game apparatus of the present invention comprises a projectile and a head garment. The head garment includes a head-fitting member configured and dimensioned to be releasably worn on the head of a player. The head garment also includes a visor attached to said head-fitting member, wherein the visor is provided with an aperture of sufficient size to allow said projectile to pass through the aperture.

DESCRIPTION OF THE PREFERRED EMBODIMENTS

Figure 1:
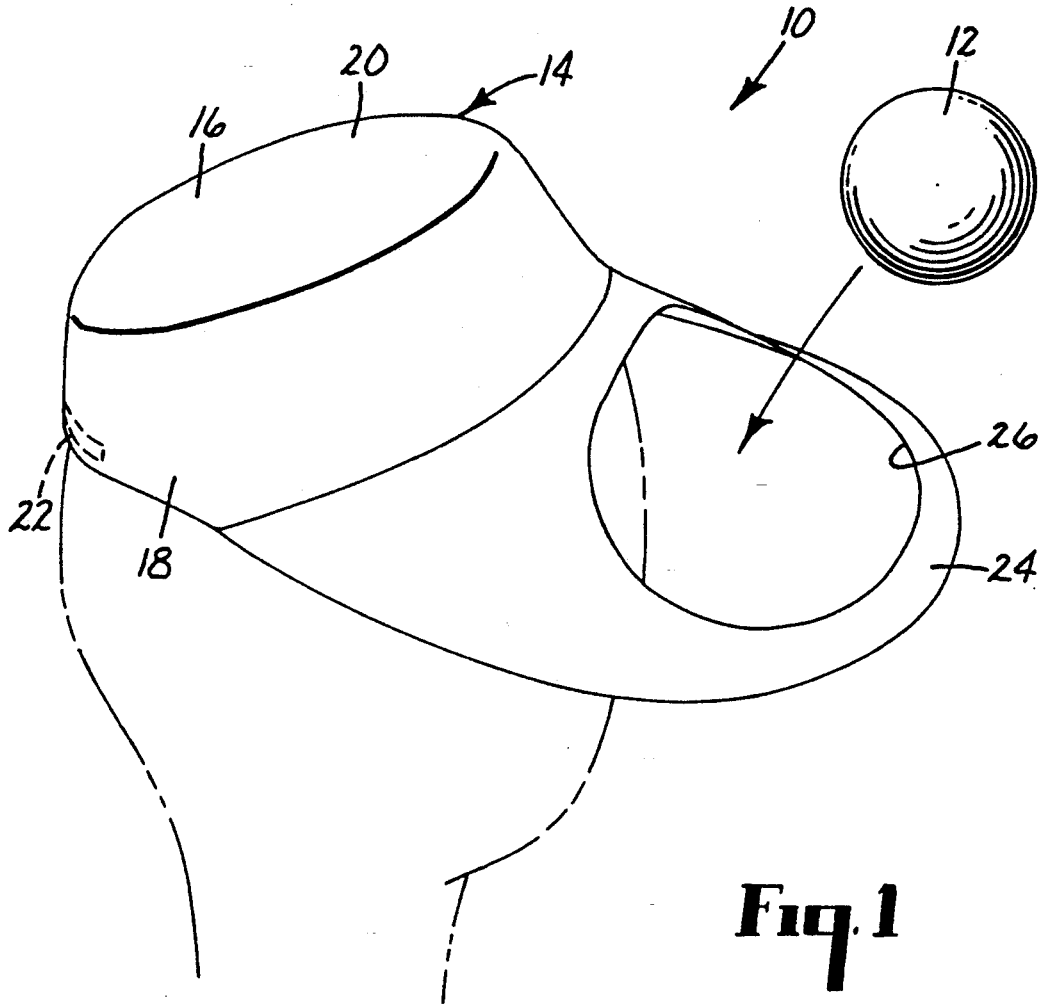
FIG. 1 shows one embodiment of the present invention configured with a peripheral band containing an elastic member.

Referring now to FIG. 1, there is shown one preferred game apparatus 10 of the present invention. The apparatus 10 generally includes one or more projectiles 12. For purposes of clarity, only one projectile 12 is shown in FIG. 1. The projectile 12 may be any of a variety of shapes, but preferably is seamless and devoid of projections. Most preferably, the projectile 12 is spherical in shape because spherical projectiles are easiest to grasp, aim, and throw.

The projectile 12 may be any of a variety of sizes. However, the projectile 12 preferably is of sufficient size so that it cannot accidently enter the mouth, ears, eyes, or nostrils of a player. The projectile 12 is preferably at least about three inches in diameter.

The projectile 12 is most advantageously made from a resilient, lightweight, spongelike material so that the projectile 12 can substantially return to its original shape after any deformation caused by throwing or impact. Suitable materials for making the projectile 12 include polymeric foams such as polyurethane, polyethylene, and polyvinyl chloride. Projectiles commercially available under the "NERF" trademark are particularly suitable in the practice of the present invention. The NERF brand projectiles are lightweight and made of a soft, resilient foam such that these projectiles can be thrown and caught indoors without causing damage to the players or the interior portions of a home.

FIG. 1 also shows a head garment 14 of the present invention. The head garment 14 includes a head-fitting member 16 configured and dimensioned to be releasably worn on the head of a player. The head-fitting member 16 includes a peripheral band 18 which is configured to fit around the head of a player. The head-fitting member 16 also includes an optional cap portion 20 attached to the peripheral band 18 such that the cap portion 20 covers the top of the player's head when the head garment 14 is worn by the player.

Preferably, the length of the peripheral band 18 is adjustable so that the head garment 14 can be adjusted to fit players of various sizes. Methods of making the peripheral band 18 adjustable are well known in the art, and any of such methods may be used in the practice of the present invention. As one example of such a method, the head garment 14 of FIG. 1 includes an elastic member 22 (shown by the dotted lines) stitched into the peripheral band 18 to allow the peripheral band to be elastically stretched.

FIG. 1 also shows a visor 24 attached to the head-fitting member 16. As shown in FIG. 1, the visor is attached to, and projects from, the front of the head-fitting member. However, in alternative embodiments of the invention, the visor may be attached to the head-fitting member in a manner such that the visor projects outward from the side, back, or top of the head-fitting member. The visor 24 is provided with an aperture 26 of sufficient size to allow the projectile 12 to pass through the aperture. The visor 24 is preferably stiffened in accordance with practices known in the art so that the visor 24 retains its shape and does not droop when worn by a player.

Figure 2:
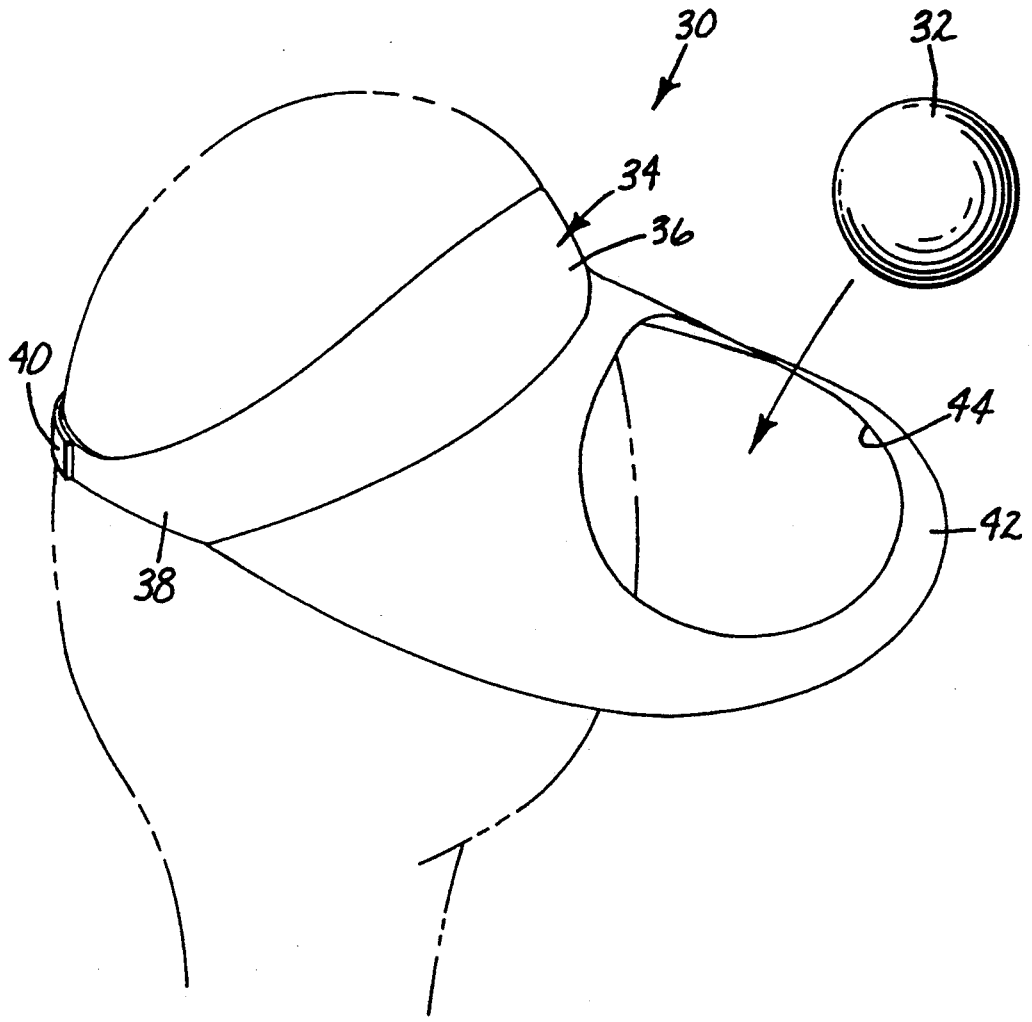
FIG. 2 shows an alternative embodiment of the present invention configured with a peripheral band having an adjustable strap.

FIG. 2 shows an alternative game apparatus 30 of the present invention. A head garment 34 includes a head-fitting member 36 comprising a peripheral band 38, but no cap portion. The peripheral band 38 includes an adjustable strap 46 so that the length of the peripheral band 38 may be adjusted to fit players of different sizes. A visor 42 is attached to the head-fitting member 36. The visor 42 is provided with an aperture 44 of sufficient size to allow the projectile 32 to pass through the aperture 44.

The game apparatus of the present invention is most preferably used with two or more players. In use, each player wears a head garment and carries one or more projectiles. Each player then tries to throw his or her projectiles through the aperture in the visors of the other players. To present a more interesting appearance, each player can wear a head garment and carry projectiles of a matching color, wherein such color is different from the colors of projectiles and head garments associated with the other players.

Other embodiments of this invention will be apparent to those skilled in the art from a consideration of this specification or from the practice of the invention disclosed herein. Various omissions, modifications, and changes to the principles described herein may be made by one skilled in the art without departing from the true scope and spirit of the invention which is indicated by the following claims.

What is claimed is:

1. A game apparatus for use in play by two or more players, comprising:

(a) a projectile, wherein the projectile is made from a resilient, sponge-like, polymeric material which is capable of substantially returning to its original shape after being deformed; and (b) a head garment, wherein the projectile is unattached to the head garment, said head garment comprising:

(i) a head-fitting member configured and dimensioned to be releasably worn on the head of a player; and (ii) a visor attached to said head-fitting member, wherein the visor is provided with a through aperture of sufficient size to allow said projectile to pass through the visor, wherein, during play, the projectile can be thrown by one player through the aperture in the visor of another player.

2. The game apparatus of claim 1, wherein the projectile is substantially spherical in shape.

3. The game apparatus of claim 2, wherein the projectile is at least about 3 inches in diameter.

4. The game apparatus of claim 1, wherein the head-fitting member comprises a peripheral band configured to fit around the head of the player.

5. The game apparatus of claim 1, wherein the head-fitting member comprises a cap portion and a peripheral band attached to the edges of the cap portion such that the cap portion covers the top of the player's head when the head garment is worn by the player.

6. The game apparatus of claim 4, wherein the peripheral band comprises an adjustable strap so that the length of the peripheral band can be adjusted to be worn by players of various sizes.

7. The game apparatus of claim 4, wherein the peripheral band comprises an elastic member so that the length of the peripheral band can be adjusted to be worn by players of various sizes.

* * * * *